US008417132B2

(12) United States Patent
Murayama

(10) Patent No.: US 8,417,132 B2
(45) Date of Patent: Apr. 9, 2013

(54) IMAGE FORMING APPARATUS

(75) Inventor: Kentaro Murayama, Kasugai (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 320 days.

(21) Appl. No.: 12/847,314

(22) Filed: Jul. 30, 2010

(65) Prior Publication Data

US 2011/0026982 A1 Feb. 3, 2011

(30) Foreign Application Priority Data

Jul. 31, 2009 (JP) ..... 2009-178986

(51) Int. Cl.
*G03G 15/00* (2006.01)

(52) U.S. Cl.
USPC ..... 399/49

(58) Field of Classification Search ..... 399/49, 399/123
See application file for complete search history.

(56) References Cited

U.S. PATENT DOCUMENTS

| | | | |
|---|---|---|---|
| 2005/0191072 A1 | 9/2005 | Okano | |
| 2008/0225307 A1 | 9/2008 | Murayama et al. | |
| 2009/0238585 A1 * | 9/2009 | Hayashi et al. | 399/40 |

FOREIGN PATENT DOCUMENTS

| | | |
|---|---|---|
| JP | 08-262829 | 10/1996 |
| JP | 2002-040746 A | 2/2002 |
| JP | 2003-291424 A | 10/2003 |
| JP | 2004-198948 A | 7/2004 |
| JP | 2005-234454 | 9/2005 |
| JP | 2007-206478 A | 8/2007 |
| JP | 2008-225192 | 9/2008 |

OTHER PUBLICATIONS translation of Nakajima (JP2004198948 A), listed in IDS, pub date: Jul. 15, 2004.*
translation of Shimizu (JP2002040746 A), listed in IDS, pub date: Feb. 6, 2002.*
JP Office Action dtd May 24, 2011, JP Appln. 2009-178986, partial English translation.

* cited by examiner

*Primary Examiner* — Walter L Lindsay, Jr.
*Assistant Examiner* — Frederick Wenderoth
(74) *Attorney, Agent, or Firm* — Banner & Witcoff, Ltd.

(57) ABSTRACT

An image forming apparatus is provided. The apparatus includes an exposure section configured to form an electrostatic latent image, a developing section configured to supply developer to the electrostatic latent image to form a developer image, a first carrier configured to rotate while carrying thereon the developer image formed by the developing section, a second carrier configured to interpose a recording medium with the first carrier and configured to indirectly carry the developer image transferred from the first carrier to the recording medium, and a correction section configured to correct a formation position of the electrostatic latent image with using a correction value which is based on a use level of developer corresponding to at least one of an amount of developer and a coverage of developer in the developer image.

18 Claims, 12 Drawing Sheets

IMAGE FORMING APPARATUS

CROSS-REFERENCE TO RELATED APPLICATION

This application claims priority from Japanese Patent Application No. 2009-178986, filed on Jul. 31, 2009, the entire subject matter of which is incorporated herein by reference.

TECHNICAL FIELD

Aspects of the present invention relate to an image forming apparatus having a function of correcting deviation of an image forming position.

BACKGROUND

An image forming apparatus has a function of correcting deviation of an image forming position in order to ensure the quality of an image formed. For example, JP-A-2008-225192 discloses an electrophotographic image forming apparatus including a plurality of photosensitive drums aligned along a belt for sheet transport, so that toner images of respective colors carried on the photosensitive drums are sequentially transferred onto a sheet on the belt. In this image forming apparatus, in order to correct a positional deviation, a pattern is formed on the belt surface using toner of each color and the amount of deviation from an ideal position of the image forming position of each color is calculated by measuring the position of a mark of each color included in the pattern with an optical sensor. The correction value for canceling the calculated amount of positional deviation of each color is stored in a memory, and the image forming position of each color is corrected based on the correction value read from the memory at the time of image formation.

SUMMARY

According to study of the inventor, when forming an image, the position of an image could deviate due to a difference of a toner amount or a toner area in a toner image. The inventor thinks the reason for this is that toner interposed between a photosensitive drum and a sheet changes the frictional force acting between the photosensitive drum and the sheet, so that the relative movement speed between the photosensitive drum and the sheet slightly changes. Since such positional deviation has not been taken into consideration in the related-art positional deviation correction technique, there is a room for improvement.

Accordingly, it is an aspect of the present invention to provide an image forming apparatus capable of correcting an image forming position more precisely.

According to an illustrative embodiment of the present invention, there is provided an image forming apparatus comprising: an exposure section configured to form an electrostatic latent image; a developing section configured to supply developer to the electrostatic latent image to form a developer image; a first carrier configured to rotate while carrying thereon the developer image formed by the developing section; a second carrier configured to interpose a recording medium with the first carrier and configured to indirectly carry the developer image transferred from the first carrier to the recording medium; and a correction section configured to correct a formation position of the electrostatic latent image with using a correction value which is based on a use level of developer corresponding to at least one of an amount of developer and a coverage of developer in the developer image.

According to another illustrative embodiment of the present invention, there is provided an image forming apparatus comprising: an exposure section configured to form an electrostatic latent image; a developing section configured to supply developer to the electrostatic latent image to form a developer image; a first carrier configured to rotate while carrying thereon the developer image formed by the developing section; a second carrier configured to rotate while contacting the first carrier, and configured to carry the developer image transferred from the first carrier to transfer the carried developer image on a recording medium directly or indirectly; and a correction section configured to correct a formation position of the electrostatic latent image using a correction value which is based on a use level of developer corresponding to at least one of an amount of developer and a coverage of developer in the developer image.

According to a further illustrative embodiment of the present invention, there is provided an image forming apparatus comprising: a plurality of photosensitive drums configured to be rotationally driven; a plurality of exposure sections configured to form electrostatic latent images on the photosensitive drums, respectively; a plurality of developing sections configured to supply developer to the electrostatic latent images to form developer images, respectively; a belt configured to transport a recording medium so that the recording medium contacts the plurality of developing sections; a plurality of transfer sections configured to transfer the developer images formed on the plurality of photosensitive drums onto the recording medium on the belt, respectively; and a correction section configured to correct a formation position of each of the electrostatic latent images with using a correction value which is based on a use level of developer corresponding to at least one of an amount of developer and a coverage of developer in the developer images.

According to the above configuration, the precision of positional deviation correction can be improved by correcting the position of an electrostatic latent image using the correction value based on a use level of developer in a transferred developer image.

BRIEF DESCRIPTION OF THE DRAWINGS

The above and other aspects of the present invention will become more apparent and more readily appreciated from the following description of exemplary embodiments of the present invention taken in conjunction with the attached drawings, in which.

DETAILED DESCRIPTION

Hereinafter, an illustrative embodiment of the present invention will be described with reference to FIGS. 1 to 12.

(Overall Configuration of a Printer)

Figure 1:
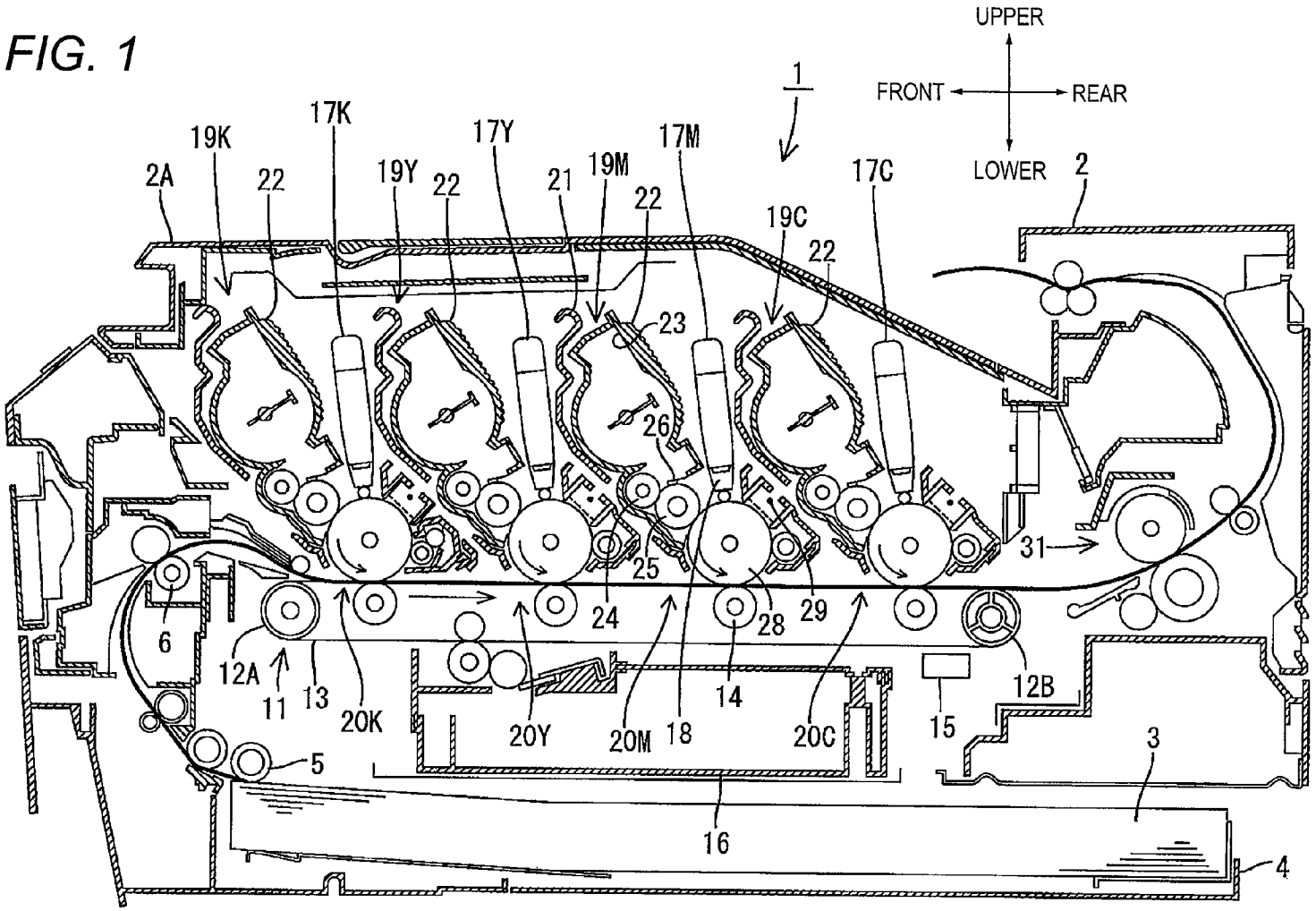
FIG. 1 is a side sectional view showing the schematic configuration of a printer according to an illustrative embodiment of the present invention.

FIG. 1 is a side sectional view showing the schematic configuration of a printer 1 (an example of an image forming apparatus) according to the illustrative embodiment. The printer 1 is a so-called direct transfer tandem type color laser printer. In the following description, the left side in this drawing is defined as the front side, and the right side is defined as the rear side. In FIG. 1, some reference numerals are omitted for the same components of respective colors.

The printer 1 includes a body casing 2, and a cover 2A which can be opened or closed and is provided on an upper portion of the body casing 2. A supply tray 4 which accommodates a plurality of sheets 3 (an example of recording media) is provided in a bottom portion within the body casing 2. The sheet 3 set in the supply tray 4 is fed to a registration roller 6 by a sheet feed roller 5. The registration roller 6 transports the sheet 3 onto a belt unit 11.

The belt unit 11 has a configuration in which an annular (endless) belt 13 is wound between a support roller 12A provided at the front side and a belt driving roller 12B provided at the rear side. The belt support roller 12A is biased frontward by a spring (not shown), so that tension is given to the belt 13. The belt 13 is formed of a resin material, such as polycarbonate, and the outer peripheral surface of the belt 13 is processed into a mirror surface form. The belt 13 rotates clockwise in FIG. 1 by rotational driving of the belt driving roller 12B and transports the sheet 3 rearward, which is electrostatically absorbed on the upper surface of the belt 13.

At the inner side of the belt 13, a transfer roller 14 (an example of a transfer section) is provided at the position opposing a photosensitive drum 28 of each of process sections 19K to 19C (described later), with the belt 13 interposed therebetween. Each transfer roller 14 is biased toward the corresponding photosensitive drum 28 by a spring (not shown) and is rotated by the movement of the belt 13.

A pair of pattern sensors 15 (an example of a measurement section) is provided below the belt 13 on the left and right sides. The pair of pattern sensors 15 detects a pattern and the like formed on the belt 13. Each pattern sensor 15 illuminates light onto the surface of the belt 13, receives the reflected light by a phototransistor or the like, and outputs a signal with a level corresponding to the amount of received light. A cleaner 16 is provided below the belt unit 11. The cleaner 16 collects toner, sheet particles, and the like adhering to the surface of the belt 13.

Four exposure sections 17K, 17Y, 17M, and 17C and the four process sections 19K, 19Y, 19M, and 19C are provided above the belt unit 11 so as to be aligned in the front-rear direction. Each of the exposure sections 17K to 17C, each of the process sections 19K to 19C, and each of the transfer rollers 14 form each of image forming sections 20K, 20Y, 20M, and 20C. The image forming sections 20K, 20Y, 20M, and 20C can form toner images (an example of a developer image) of black, yellow, magenta, and cyan on a sheet 3 and the belt 13 from the upstream side, respectively.

Each of the exposure sections 17K to 17C (an example of an exposure section) is supported on a bottom surface of the cover 2A and has an LED head 18. Each of the exposure sections 17K to 17C includes a plurality of LEDs provided in a line in a lower end portion thereof. Emission control of each of the exposure sections 17K to 17C is performed on the basis of the image data to be printed. Each of the exposure sections 17K to 17C scans light from the LED head 18 onto the surface of the corresponding photosensitive drum 28 for every line.

Each of the process sections 19K to 19C includes a cartridge frame 21 and a developing cartridge 22 (an example of a developing section) which is detachably mounted in the cartridge frame 21. When the cover 2A is opened, each of the exposure sections 17K to 17C retreats upward together with the cover 2A and each of the process sections 19K to 19C can be individually attached or detached with respect to the body casing 2.

Each developing cartridge 22 includes a toner receiving chamber 23 for storing toner (an example of developer) and also includes a supply roller 24, a developing roller 25, a layer thickness regulating blade 26, and the like below the toner receiving chamber 23. As the toner, positively chargeable non-magnetic one-component polymer toner is used, for example. Toner discharged from the toner receiving chamber 23 is supplied to the developing roller 25 by the supply roller 24 and is positively charged by friction between the supply roller 24 and the developing roller 25. The toner on the developing roller 25 becomes a thin layer by the layer thickness regulating blade 26 and is then charged by friction.

The photosensitive drum 28 (an example of a first carrier) and a charger 29 are provided below the cartridge frame 21. The photosensitive drum 28 is obtained by forming a photosensitive layer, which is formed of an organic sensitive material including positively charged polycarbonate and the like, on the outer peripheral surface of a cylindrical drum body formed of a conductive material, such as aluminum. The photosensitive drum 28 is supported in a state where the drum body is grounded and is driven to rotate counterclockwise in the drawing.

The surface of the photosensitive drum 28 is positively charged by the charger 29, the positively charged portion is exposed by scanning of each of the exposure sections 17K to 17C. Accordingly, an electrostatic latent image is formed on the surface of the photosensitive drum 28. Then, toner is supplied to the electrostatic latent image from the developing roller 25 to which a developing bias is applied. Accordingly, a toner image is formed on the photosensitive drum 28.

The toner image carried on each photosensitive drum 28 is sequentially transferred onto a sheet 3 by a negative transfer voltage applied to the transfer roller 14 so as to overlap each other while the sheet 3 on the belt 13 is passing through each transfer position between the photosensitive drum 28 and the transfer roller 14. The sheet 3 on which the toner image (an example of a multi-color developer image) has been transferred is heat-fixed by a fixer 31 and is then discharged to the upper surface of the cover 2A.

(Electrical Configuration of a Printer)

Figure 2:
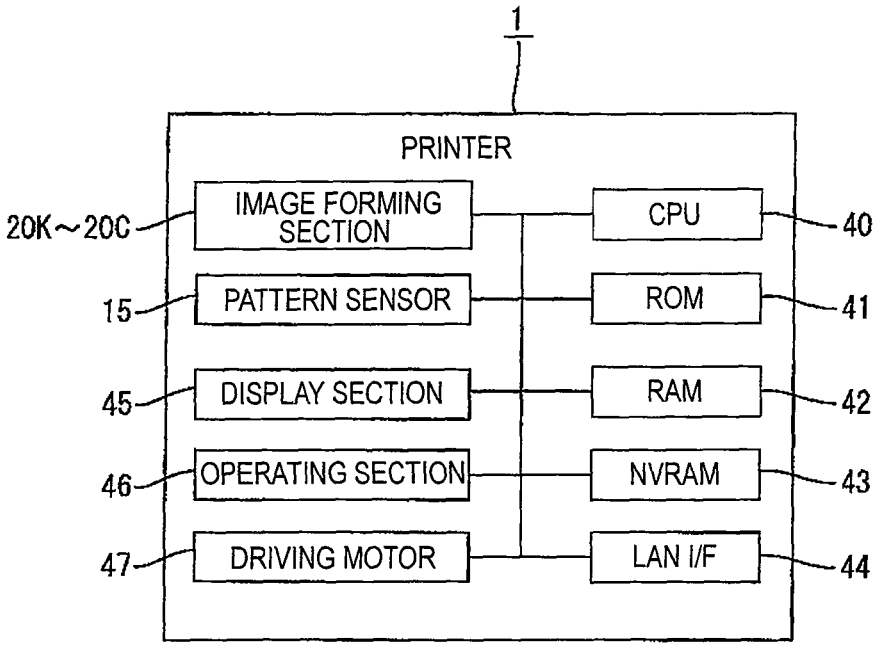
FIG. 2 is a block diagram schematically showing the electrical configuration of the printer.

FIG. 2 is a block diagram schematically showing the electrical configuration of the printer 1.

The printer 1 includes a Central Processing Unit (CPU) 40, a Read Only Memory (ROM) 41, a Random Access Memory (RAM) 42, a nonvolatile RAM (NVRAM) 43, and a network interface 44. A program for executing various operations of the printer 1, such as positional deviation detection processing and print job execution processing (described later) is stored in the ROM 41. The CPU 40 (an example of a correction section) controls each section according to the program read from the ROM 41 while storing the processing result in the RAM 42 or the NVRAM 43. The network interface 44 is connected to an external computer through a communication line, such as a LAN. In this case, data communication between the network interface 44 and the external computer becomes possible.

The printer 1 includes a display section 45 and an operating section 46. The display section 45 has a liquid crystal display, a lamp, and the like. The display section 45 can display various kinds of setting screens, operating states of the apparatus, and the like. The operating section 46 (an example of an input section) has a plurality of buttons. Using the operating section 46, the user can input various kinds of instructions.

The printer 1 includes a driving motor 47 in addition to the image forming sections 20K to 20C and the pattern sensor 15. The driving motor 47 is formed by one or more of motors and drives the registration roller 6, the belt driving roller 12B, the developing roller 25, the photosensitive drum 28, and the like to rotate through a gear mechanism (not shown).

(Relationship Between the Use Level of Toner and Positional Deviation)

Next, the relationship between the use level of toner and positional deviation in a toner image formed on a sheet 3 will be described.

In the printer 1, assuming that the driving speed of each photosensitive drum 28 when forming an image is 100, for example, the driving speed of the surface of the belt 13 would be set to 100.3. That is, the driving speed of the surface of the belt 13 is set to be slightly larger than the driving speed of each photosensitive drum 28. Accordingly, each photosensitive drum 28 and the belt 13 are driven at the speed when forming an image. In a state where the sheet 3 is not transported, the force (resistive force) acts in a direction of decelerating the belt 13 from each photosensitive drum 28 to the belt 13. In this case, since the surface of the belt 13 is mirror-finished as described above, the frictional force which acts between each photosensitive drum 28 and the belt 13 is relatively small. Accordingly, slipping between each photosensitive drum 28 and the belt 13 occurs.

When the sheet 3 enters between each photosensitive drum 28 and the belt 13 in this state, the resistive force that the belt 13 receives from the photosensitive drum 28 (through the sheet 3) increases since the coefficient of friction between the photosensitive drum 28 and the sheet 3 is larger than that between the photosensitive drum 28 and the belt 13. Herein, the slipping occurring between the sheet 3 electrostatically absorbed on the surface of the belt 13 and the belt 13 is assumed to be negligible.

According to the study of the inventor, when forming an image, the magnitude of the frictional force which acts between each photosensitive drum 28 and the sheet 3 changes by the influence of toner interposed between each photosensitive drum 28 and the sheet 3. In addition, the change in the magnitude of the frictional force changes the relative movement speed between the sheet 3 and the photosensitive drum 28. As a result, positional deviation of an image formed on the sheet 3 occurs.

It is thought that the magnitude of the frictional force between the photosensitive drum 28 and the sheet 3 changes with the amount of toner or the coverage of toner in a toner image transferred from each photosensitive drum 28 to the sheet 3. Here, the amount of toner includes the weight, the volume, and the concentration of toner, for example. The coverage of toner includes the area of a portion to which toner adheres, the ratio of the printing area with respect to the printing region area on the sheet 3, and the rate of the number of pixels to which toner adheres to the number of pixels corresponding to the printing region on the sheet 3, for example. Here, a value based on at least one of the amount of toner and the coverage of toner is used as the use level of toner.

Figure 3:
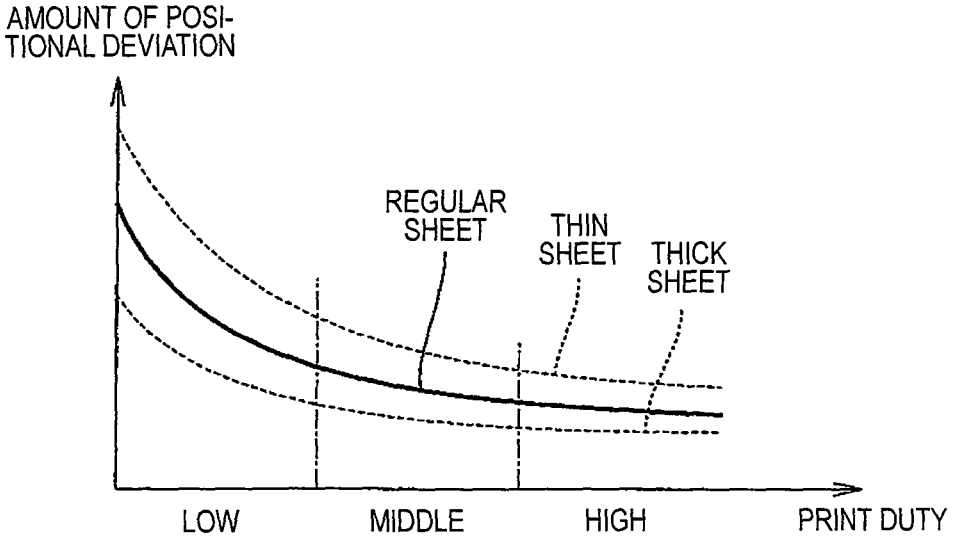
FIG. 3 is a graph showing the relationship between the print duty and the amount of positional deviation.

FIG. 3 is a graph showing the relationship between the print duty and the amount of positional deviation. The print duty is an example of the use level of toner. For example, the print duty is calculated as the rate of the number of pixels to which toner adheres with respect to the number of pixels corresponding to the printing region on the sheet 3. In addition, the amount of positional deviation expressed by the graph is the amount of positional deviation of a toner image of one of three colors excluding black from four toner images, and indicates the amount of deviation of the image forming position in the sub-scanning direction with the image forming position using black as a reference.

This graph shows the amount of positional deviation with the image forming position in a state where there is no sheet 3 between each photosensitive drum 28 and the belt 13 as a reference. That is, when forming an image from each photosensitive drum 28 onto the belt 13, the amount of positional deviation is 0. In addition, this graph shows only the amount of positional deviation relevant to the magnitude of print duty and does not show the amount of positional deviation which is not related to the print duty.

As described above, when the sheet 3 enters between each photosensitive drum 28 and the belt 13, the resistive force that the belt 13 receives from the side of the photosensitive drum 28 increases. In this case, since a portion of the belt 13 extends temporarily or the belt 13 slides from the belt driving roller 12B, for example, the speed of the sheet 3 becomes slow compared with the speed of the belt 13 before the sheet 3 enters between each photosensitive drum 28 and the belt 13. Accordingly, the image forming position on the sheet 3 shifts rearward.

In addition, since the relative speed of the sheet 3 with respect to each photosensitive drum 28 may change during the printing onto one sheet 3, the amount of positional deviation in the sub-scanning direction may also change during the printing onto one sheet 3. In this illustrative embodiment, unless particularly defined, the average amount of deviation on one sheet 3 is assumed to be the amount of positional deviation.

As shown in FIG. 3, as the print duty increases, the frictional force between each photosensitive drum 28 and the sheet 3 decreases. That is, since it becomes close to a state when there is no sheet 3 as the print duty increases, the amount of positional deviation decreases. On the contrary, as the print duty decreases, the amount of positional deviation increases.

It is thought that the amount of positional deviation is also influenced by the type of the sheet 3. As shown in FIG. 3, when the sheet 3 is thin sheet, the frictional force with respect to the photosensitive drum 28 increases compared with the case of regular sheet which has a normal thickness. Accordingly, the amount of positional deviation increases. On the contrary, when the sheet 3 is thick sheet, the frictional force decreases compared with the case of regular sheet. Accordingly, the amount of positional deviation decreases.

The change in the amount of positional deviation shown in FIG. 3 is a mere example. That is, the amount of positional deviation may change according to various conditions, such as a material of the photosensitive drum 28 or the belt 13, driving methods (speed setting and the like) of the photosensitive drum 28 and the belt 13, the magnitude of the biasing force of the transfer roller 14 with respect to the photosensitive drum 28, a material of sheet, and presence of coating.

(Positional Deviation Detection Processing)

Figure 4:
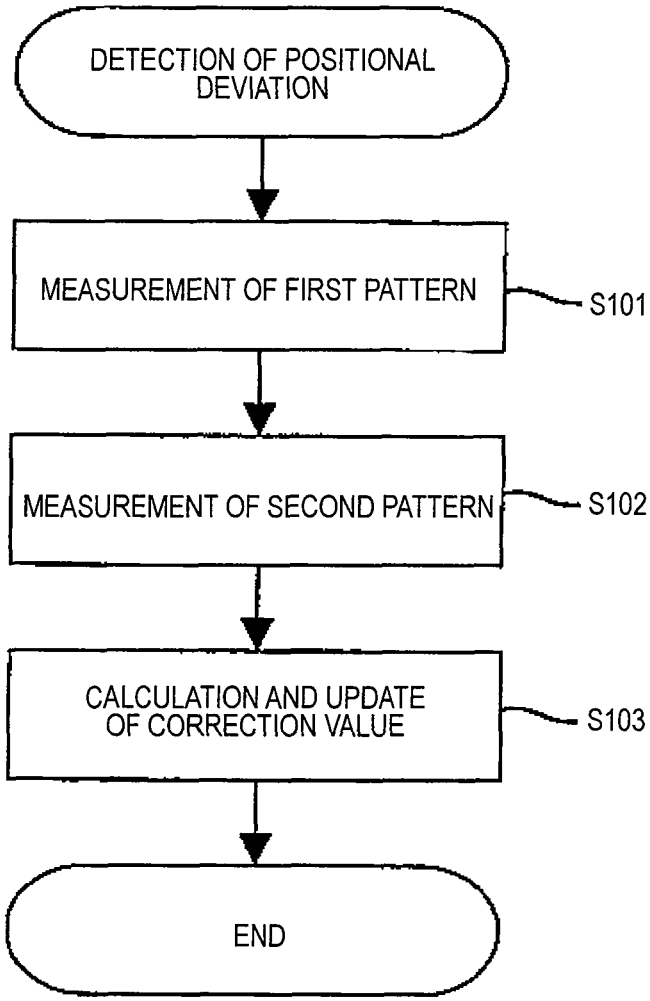
FIG. 4 is a flow chart showing positional deviation detection processing.
Figure 5:
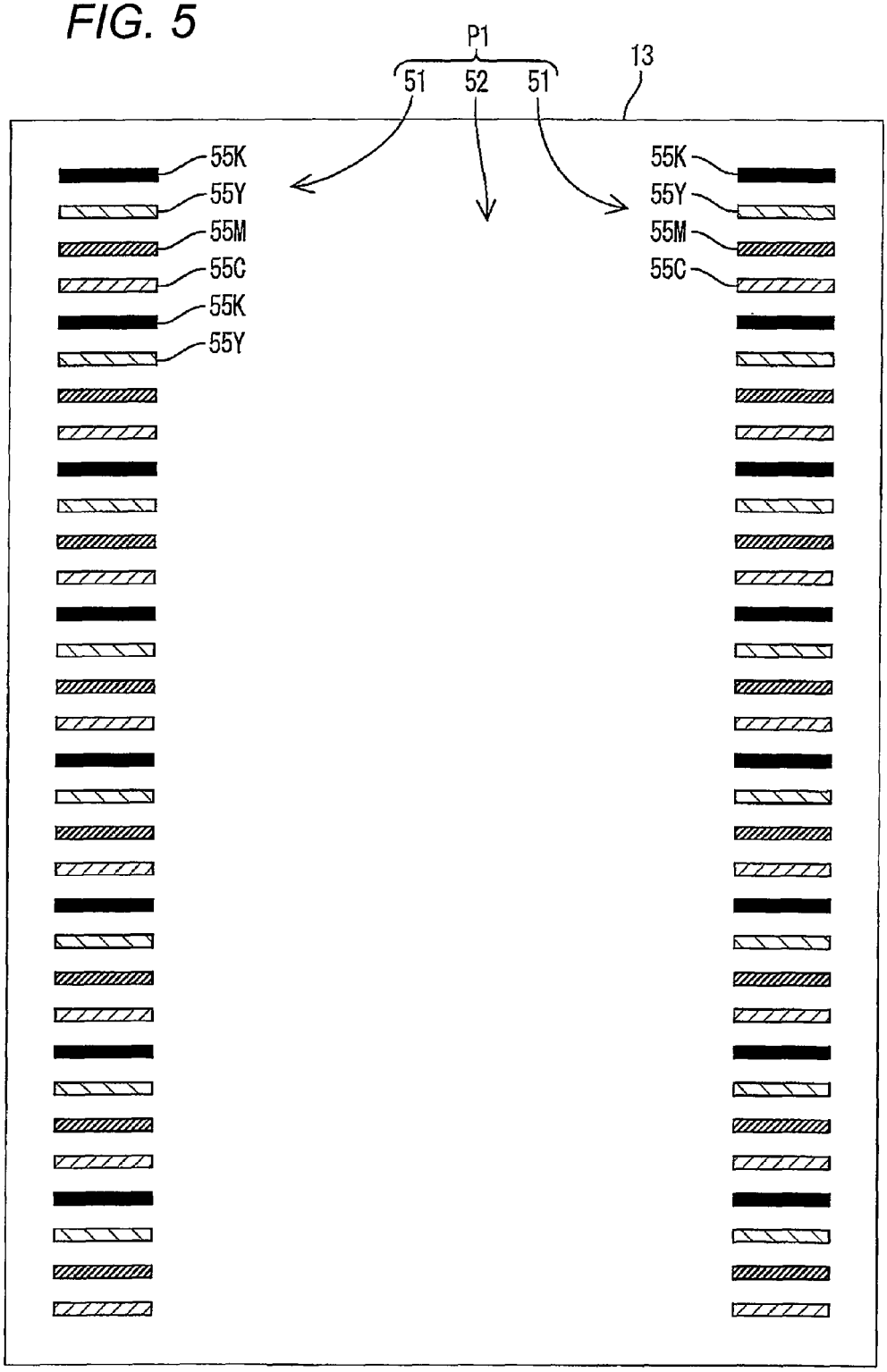
FIG. 5 is a plan view showing a first pattern formed on a belt.
Figure 6:
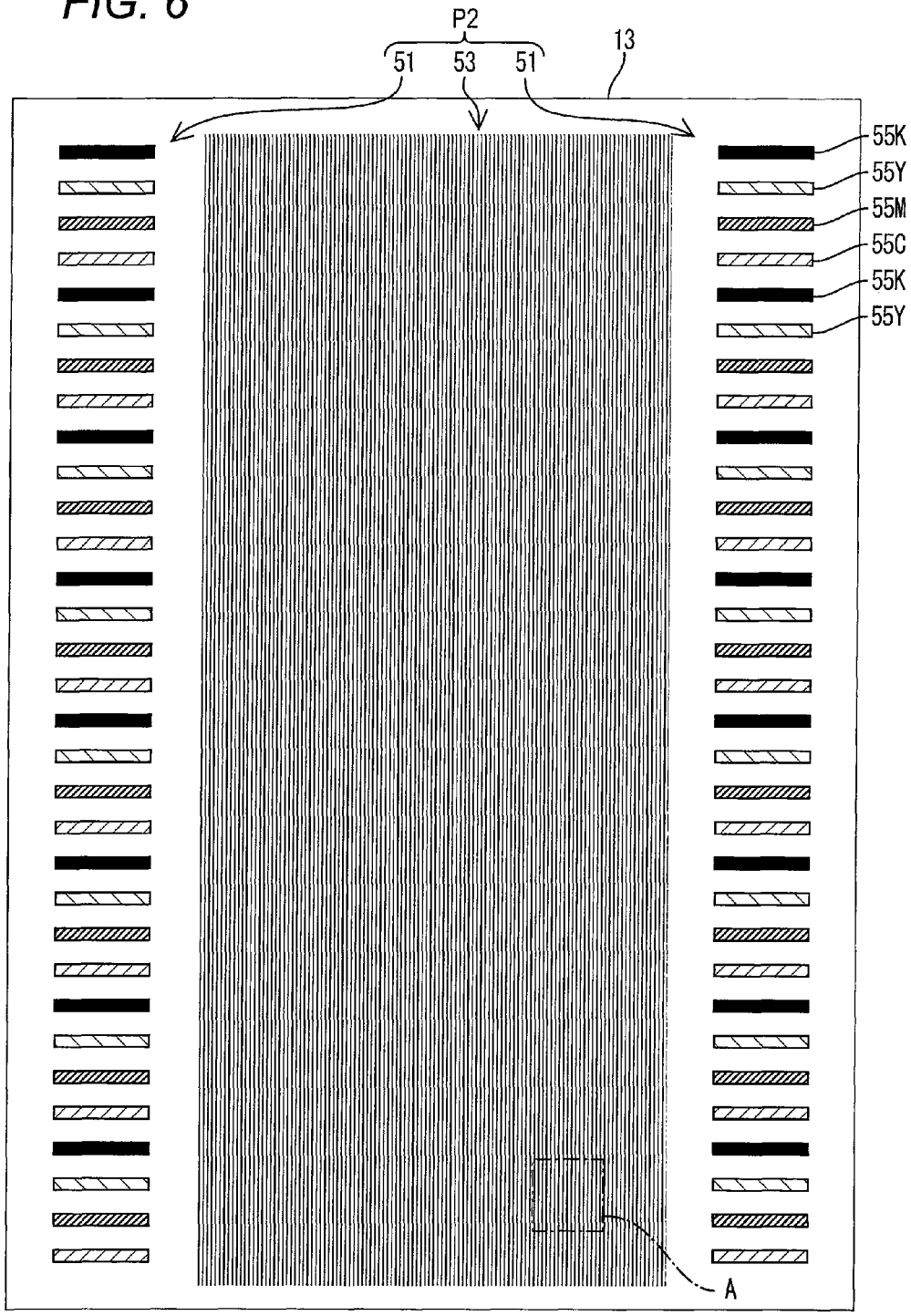
FIG. 6 is a plan view showing a second pattern formed on the belt.
Figure 7:
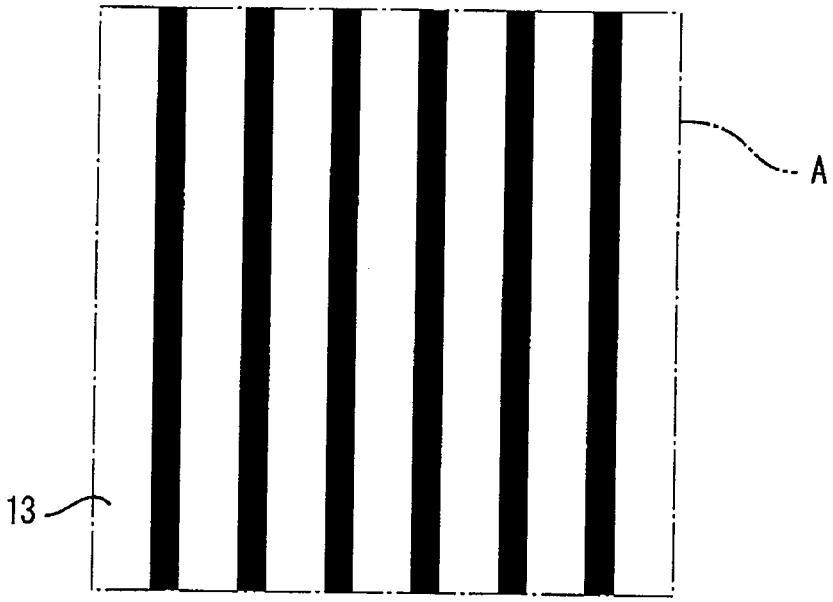
FIG. 7 is a partially enlarged plan view of a region A shown in FIG. 6.

FIG. 4 is a flow chart showing positional deviation detection processing. FIG. 5 is a plan view showing a first pattern P1 formed on the belt 13, and FIG. 6 is a plan view showing a second pattern P2 formed on the belt 13 in the same manner. FIG. 7 is a partially enlarged view of a region A shown in FIG. 6.

This positional deviation detection processing is executed by control of the CPU 40 when a predetermined condition is satisfied, for example, immediately after power on, when it is detected that the cover 2A is opened or closed, when a predetermined time has passed from the last positional deviation detection processing, or when a predetermined number of sheets have been printed.

The CPU 40 stores the positional deviation correction value of each color in the NVRAM 43 and corrects the image forming position using the positional deviation correction value at the time of printing (described later). In this positional deviation detection processing, the amount of positional deviation of each color is measured using two kinds of patterns of the first pattern P1 shown in FIG. 5 and the second pattern P2 shown in FIG. 6, and the positional deviation correction value stored in the NVRAM 43 is updated on the basis of the result.

The first pattern P1 has measurement mark portions 51, which are formed in both left and right side portions on the surface of the belt 13, and a difference pattern portion 52 formed between the measurement mark portions 51 on the left and right sides. The second pattern P2 has measurement mark portions 51, which are formed in both left and right side portions on the surface of the belt 13, and a difference pattern portion 53 formed between the measurement mark portions 51 on the left and right sides. The pair of measurement mark portions 51 is common between the first and second patterns P1 and P2. Each of the pair of measurement mark portions 51 is provided in the detection region of the corresponding pattern sensor 15, and the pair of measurement mark portions 51 is the same image.

Each measurement mark portion 51 includes the marks 55K, 55Y, 55M, and 55C which are long in the main scanning direction (width direction of the belt 13). In each measurement mark portion 51, assuming that the four marks 55K to 55C aligned in order of black, yellow, magenta, and cyan is one group, a plurality of groups of marks 55K to 55C are provided on the periphery of the belt 13 with distances interposed therebetween in the sub-scanning direction (movement direction of the belt 13). If the marks 55K to 55C are formed at the ideal positions without positional deviation in the sub-scanning direction, the distances between the adjacent marks 55K to 55C are equal.

The difference pattern portions 52 and 53 are portions for adjusting the patterns P1 and P2 to different print duties, respectively. That is, a toner image is not formed in the difference pattern portion 52 of the first pattern P1. In the difference pattern portion 53 of the second pattern P2, one third of the area is printed by black toner with a concentration of 100% and a toner image is not formed in the other portions, as shown in FIG. 7. As a result, the print duty of the first pattern P1 becomes about 0%, and the print duty of the second pattern P2 becomes about 33% (it is assumed that the area of a toner image of the measurement mark portion 51 is relatively small).

When the positional deviation detection processing shown in FIG. 4 starts, the CPU 40 forms the first pattern P1 on the belt 13 by the image forming sections 20K to 20C and measures the first pattern P1 by the pattern sensor 15 (S101). Here, for the marks 55K to 55C of each group, the CPU 40 measures a timing at which each of the marks 55K to 55C passes through the detection region of the pattern sensor 15 with a signal from the pattern sensor 15 and calculates, on the basis of the result, the amounts of positional deviation of the marks 55Y, 55M, and 55C of the other colors (called correction colors) in the sub-scanning direction using the black mark 55K as a reference. After the measurement is completed, the first pattern P1 is removed from the belt 13 by the cleaner 16.

Then, the CPU 40 forms the second pattern P2 on the belt 13 by the image forming sections 20K to 20C and measures the second pattern P2 (S102). It is noted that when forming the measurement mark portion 51 of the second pattern P2, the measurement mark portion 51 is formed such that the writing position of an electrostatic latent image on the surface of the photosensitive drum 28 when forming at least the first marks 55K to 55C (an example of the reference position) is almost the same for all colors.

In other words, the CPU 40 forms and measures the first pattern P1 on the belt 13 in a state where each of the image forming sections 20K to 20C is driven at a constant speed and then starts writing of the second pattern P2 at a timing when a time corresponding to an integral multiple of the rotation period of the photosensitive drum 28 has passed from the start timing of writing of the first pattern P1 using each of the exposure sections 17K to 17C. That is, each image forming position may change periodically in the sub-scanning direction due to the eccentricity of the photosensitive drum 28 or the like. For this reason, depending on the writing timing of the first and second patterns P1 and P2, one measurement mark portion 51 may be formed in a state of deviating back and forth from the other measurement mark portion 51. This has an adverse effect on the precision of the positional deviation correction value to be described later. In contrast, according to this illustrative embodiment, by matching the rotation phases of the photosensitive drums 28 at the writing timing of the measurement mark portions 51 of both the patterns P1 and P2, periodic variations occurring in the measurement mark portions 51 of both the patterns P1 and P2 become almost the same. As a result, an adverse effect on the precision of the positional deviation correction value can be suppressed.

The CPU 40 calculates the amount of positional deviation of each color for the measurement mark portion 51 of the second pattern P2 in the same procedure as for the first pattern P1 and calculates various kinds of positional deviation correction values, which are to be used when performing correction at the time of printing, on the basis of the measurement result of the first pattern P1 and the measurement result of the second pattern P2 (S103). Here, as shown in FIG. 3, the print duty of an image formed at the time of printing is divided into three levels of low, middle, high and the positional deviation correction value corresponding to each level is calculated for each correction color and each type of the sheet 3.

Here, the amount of deviation corresponding to the print duty of each level is first calculated for each correction color using the following expressions 1 to 3.

The amount of positional deviation when the print duty is at a high level=(amount of positional deviation measured by the second pattern P2−amount of positional deviation measured by the first pattern P1)×α [Expression 1]

The amount of positional deviation when the print duty is at a middle level=(amount of positional deviation measured by the second pattern P2−amount of positional deviation measured by the first pattern P1)×β [Expression 2]

The amount of positional deviation when the print duty is at a low level=(amount of positional deviation measured by the second pattern P2−amount of positional deviation measured by the first pattern P1)×γ [Expression 3]

wherein α, β, and γ are predetermined coefficients and $0<\alpha<\beta<\gamma$ is satisfied, for example.

That is, it is thought that for each correction color, the difference between the amount of positional deviation measured by the second pattern P2 and the amount of positional deviation measured by the first pattern P1 is equivalent to the amount of positional deviation caused by the difference pattern portion 53 with the print duty of about 33%. Therefore, the amounts of positional deviation corresponding to various print duties are calculated by multiplying the difference by the predetermined coefficient. For example, when the boundary of the print duty of three levels of low, middle, and high is set to 10% and 20% as shown in FIG. 3, the amounts of positional deviation equivalent to 5%, 15%, and 30% are calculated by multiplying the difference by the predetermined coefficients α, β, and γ and are set as the amounts of positional deviation corresponding to low, middle, and high levels, respectively.

Then, using the following expression 4, the assumed amount of positional deviation for each type of sheet corresponding to the print duty of each level is calculated for each correction color.

Assumed amount of positional deviation=(amount of positional deviation measured by the first pattern P1)+(amount of positional deviation after performing correction based on the type of sheet on the amount of deviation corresponding to each print duty level) [Expression 4]

That is, correction based on the type of the sheet 3 is performed on the amount of positional deviation corresponding to the print duty of each level. For example, by multiplying the amount of positional deviation corresponding to the print duty by the predetermined coefficient, the amount of positional deviation corresponding to each type of sheet is calculated such that the amount of positional deviation increases in order of thick sheet, regular sheet, and thin sheet as shown in FIG. 3. Then, the assumed amount of positional deviation is obtained by adding the amount of positional deviation measured by the first pattern P1 to the calculated value.

The CPU 40 sets a value, which cancels each of the various kinds of assumed amounts of positional deviation calculated as described above at the time of image formation, as each positional deviation correction value. The positional deviation correction value of each correction color stored in the NVRAM 43 is updated using the positional deviation correction value calculated as described above (S103), and the positional deviation detection processing is ended.

Although only the amount of positional deviation in the sub-scanning direction is detected in the positional deviation detection processing described above, it is also possible to form and measure a pattern for measuring the amount of positional deviation in the main scanning direction on the belt 13 and then to calculate a correction value for correcting the amount of positional deviation in the main scanning direction on the basis of the result. In this case, since it is thought that an influence of the print duty on the positional deviation is very small for the main scanning direction, the processing for calculating the correction value for every print duty may be omitted.

Figure 8:
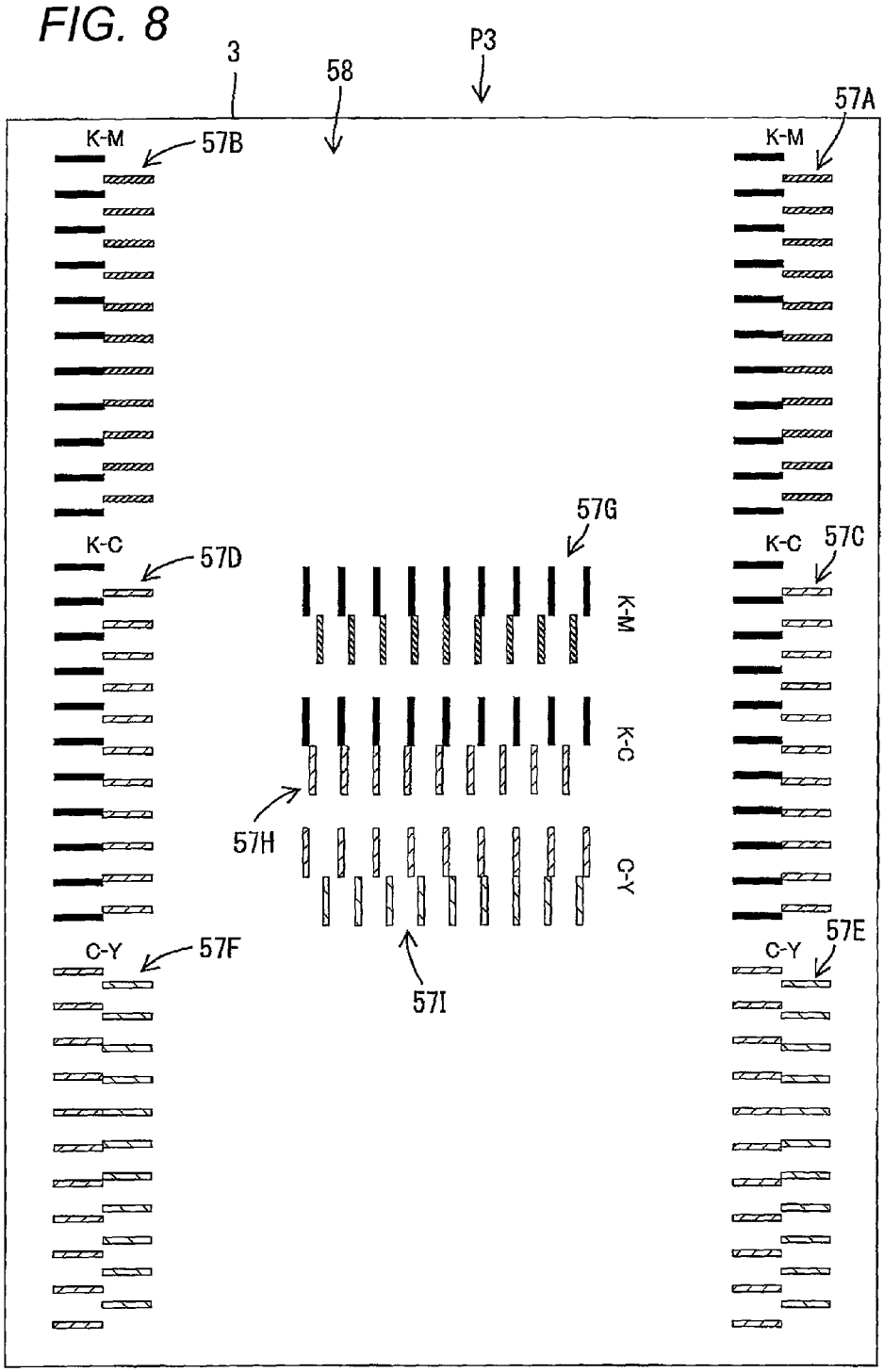
FIG. 8 is a plan view showing a first pattern formed on a sheet.
Figure 9:
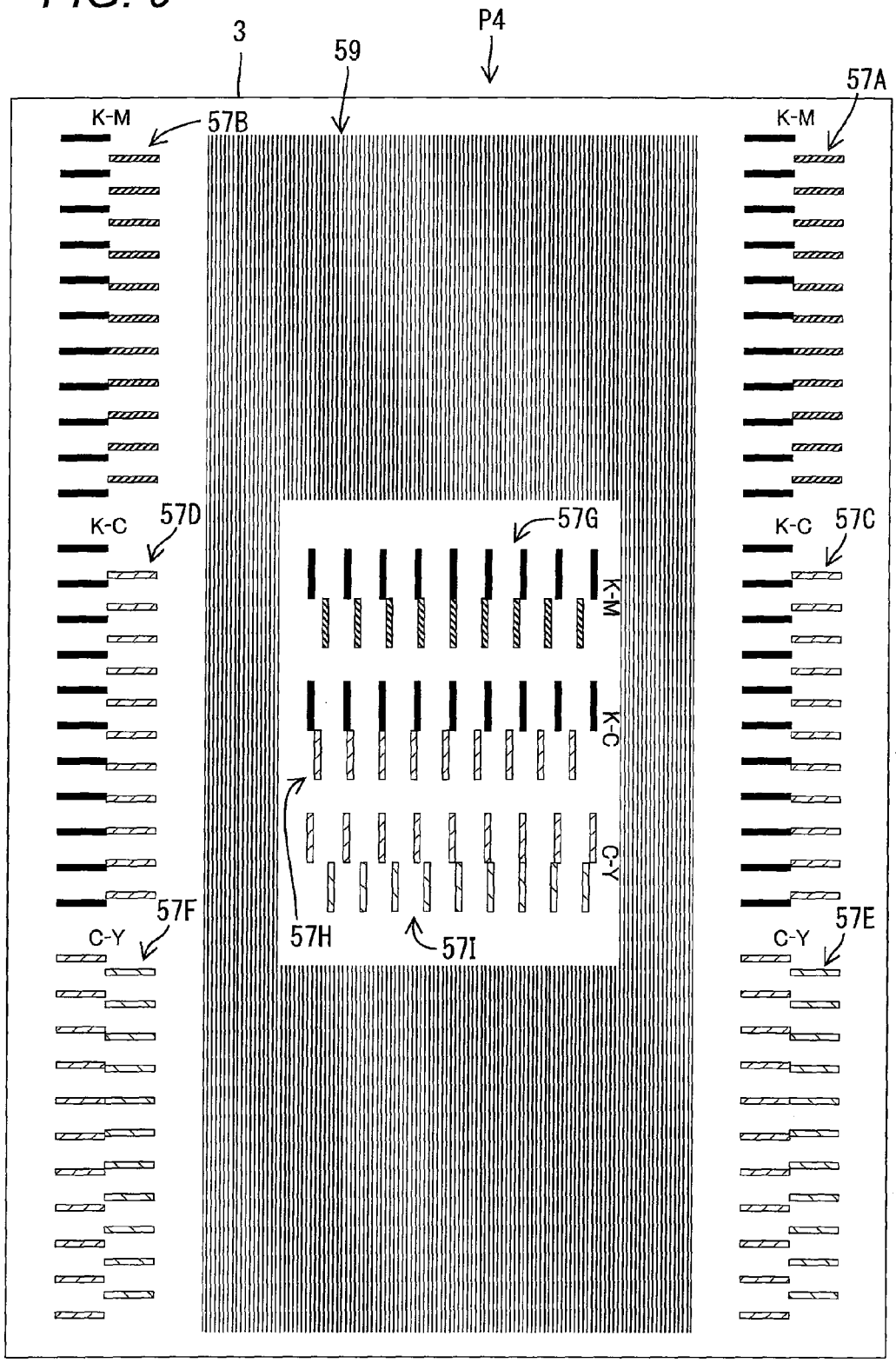
FIG. 9 is a plan view showing a second pattern formed on a sheet.
Figure 10:
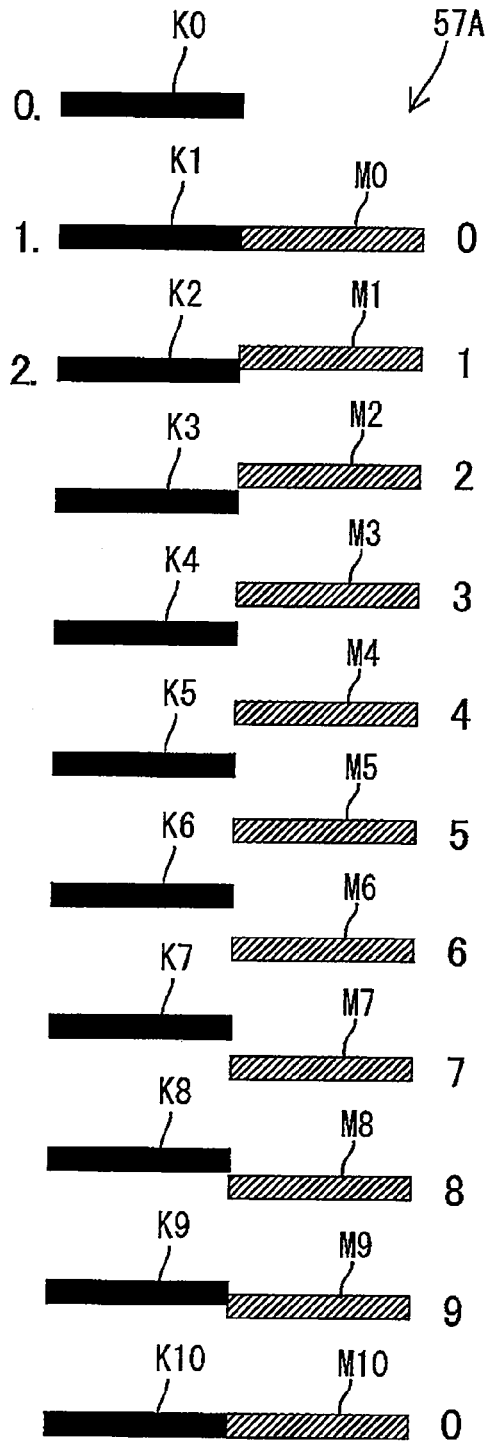
FIG. 10 is an enlarged plan view of a measurement mark portion.
Figure 11:
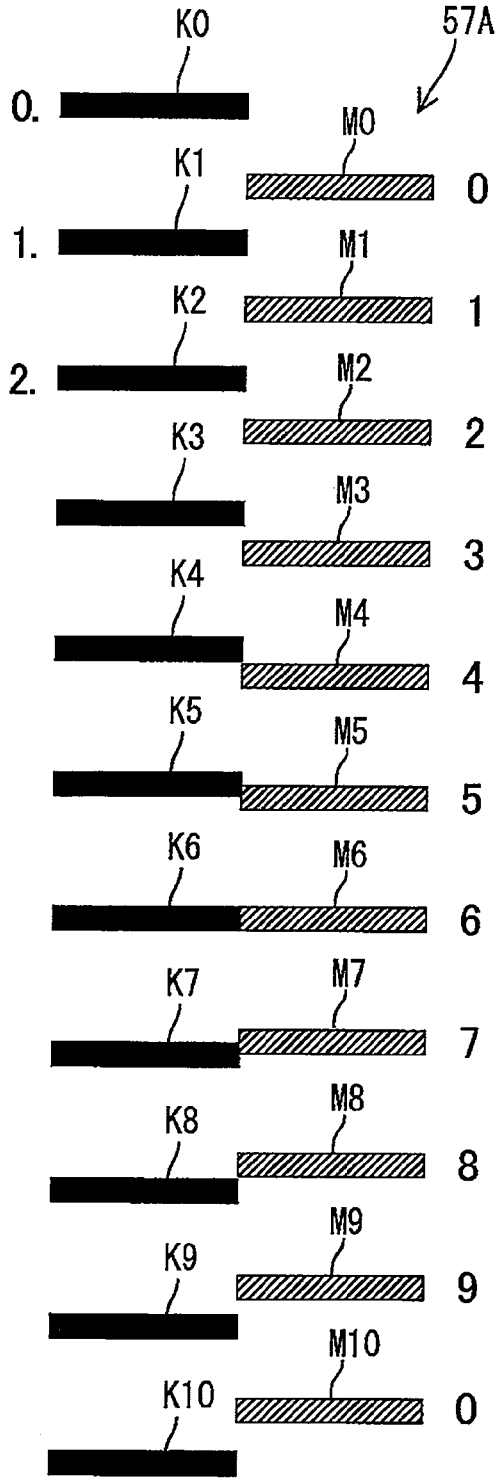
FIG. 11 is an enlarged plan view of a measurement mark portion.

Next, an example in which the amount of positional deviation is measured by a user in the above-described positional deviation detection processing is shown. FIG. 8 is a plan view showing a first pattern P3 formed on a sheet 3, and FIG. 9 is a plan view showing a second pattern P4 formed on the sheet 3 in the same manner. In addition, FIGS. 10 and 11 are plan views showing the measurement mark portion 57A.

The printer 1 may be configured to be able to selectively execute one of processing in which detection of positional deviation is performed by the patterns P1 and P2 formed on the belt 13 without intervention of a user and processing in which the detection of positional deviation is performed by the user (described later) or may be configured to execute only one of them.

As shown in FIGS. 8 and 9, the first and second patterns P3 and P4 have common measurement mark portions 57A to 57F, which are provided in both left and right side portions on the sheet 3, and measurement mark portions 57G to 571 formed in the middle portion. In addition, both the patterns P3 and P4 have difference pattern portions 58 and 59, which are formed between the measurement mark portions 57A to 57F of both the left and right side portions and in a region around the measurement mark portions 57G to 571 in the middle portion, respectively.

A toner image is not formed in the difference pattern portion 58 of the first pattern P3. In the difference pattern portion 59 of the second pattern P4, one third of the area is coated by black toner with a concentration of 100%, for example, similar to the second pattern P2 described above. Therefore, the print duty of the second pattern P4 is larger than that of the first pattern P3.

The measurement mark portions 57A to 571 are nine measurement mark portions of a pair of left and right measurement mark portions 57A and 57B for measuring the amount of positional deviation between black and magenta in the sub-scanning direction, a pair of left and right measurement mark portions 57C and 57D for measuring the amount of positional deviation between black and cyan in the sub-scanning direction, a pair of left and right measurement mark portions 57E and 57F for measuring the amount of positional deviation between cyan and yellow in the sub-scanning direction, a measurement mark portion 57G for measuring the amount of positional deviation between black and magenta in the main scanning direction, a measurement mark portion 57H for measuring the amount of positional deviation between black and cyan in the main scanning direction, and a measurement mark portion 571 for measuring the amount of positional deviation between cyan and yellow in the main scanning direction.

As shown in FIG. 10, the measurement mark portion 57A has eleven black reference lines K0 to K10 extending in the left and right direction in the drawing, eleven positional deviation detection lines M0 to M10 of magenta similarly extending in the left and right direction, scale numbers "0.", "1.", and "2." given to the reference lines K0 to K2, and scale numbers "0", "1", . . . , "9", "0" given to the positional deviation detection lines M0 to M10. The black reference lines K0 to K10 and the positional deviation detection lines M0 to M10 of magenta are formed with different pitches (here, the pitch between the black reference lines K0 to K10 is 10 dots and the pitch between the positional deviation detection lines M0 to M10 of magenta is 9 dots, for example). In addition, the number of reference lines K0 to K10 or the number of positional deviation detection lines M0 to M10, the pitch between the reference lines K0 to K10 or the pitch between the positional deviation detection lines M0 to M10, and the like may be appropriately changed.

When there is no positional deviation in the sub-scanning direction between black and magenta, the reference line K1 and the positional deviation detection line M0 are aligned on one straight line and the reference line K10 and the positional deviation detection line M10 are aligned on one straight line, as shown in FIG. 10. Moreover, for example, if the print position of magenta deviates by one dot downward in FIG. 10 from the print position of black, the reference line K2 and the positional deviation detection line M1 are aligned on one straight line.

At the time of measurement, a user reads a scale number given to the corresponding reference line according to at which position of the reference lines K0 to K10 the positional deviation detection line M0 exists. Then, the user searches a reference line and a positional deviation detection line, which are aligned on one straight line, from the reference lines K0 to K10 and the positional deviation detection lines M0 to M10 and reads a scale number given to the positional deviation detection line aligned on one straight line.

For example, when there is no positional deviation between black and magenta as shown in FIG. 10, "1.0" is set as the measurement value. When magenta deviates by 4 dots upward from black as shown in FIG. 11, the reference line K6 and the positional deviation detection line M6 are aligned on one straight line, "0.6" is set as the measurement value. For example, when the user inputs the measurement value "0.6" through the operating section 46, the CPU 40 calculates that the amount of positional deviation is 4 dots by multiplying the value "0.4" by 10, which is obtained by subtracting the measurement value "0.6" from the reference value "1.0".

For the other measurement mark portions 57B to 571, the positional deviation between different colors in the sub-scanning direction or the main scanning direction can be measured in the similar manner.

In S101 of the positional deviation detection processing shown in FIG. 4, the CPU 40 transports the sheet 3 from the supply tray 4, forms the first pattern P3 on the sheet 3 by the image forming sections 20K to 20C, and discharges it. The user inputs the measurement value of each of the measurement mark portions 57A to 57I as a measurement result through the operating section 46 while observing the first pattern P3 formed on the sheet 3.

Then, in S102, the CPU 40 transports the sheet 3, which is different from the sheet 3 on which the first pattern P3 is formed, from the supply tray 4 and forms the second pattern P4 on the sheet 3. Then, the user similarly inputs the measurement value of each of the measurement mark portions 57A to 57I as a measurement result through the operating section 46 while viewing the second pattern P4 formed on the sheet 3.

After acquiring the measurement results of the two patterns P3 and P4 as described above, the CPU 40 calculates the amount of positional deviation of each correction color with respect to the image forming position of black and calculates various positional deviation correction values in almost the same procedure as described above on the basis of the amount of positional deviation of each correction color in S103. In addition, when correction corresponding to the type of sheet is performed on the amount of positional deviation calculated according to the print duty of each level as described above, the correction is performed on the basis of the sheet 3 used for measurement. For example, when regular sheet is used as the sheet 3, it is not necessary to perform correction on the amount of positional deviation of the regular sheet. Correction for increasing the value may be performed for the amount of positional deviation of thin sheet, and correction for decreasing the value may be performed for the amount of positional deviation of thick sheet.

(Print Job Execution Processing)

Figure 12:
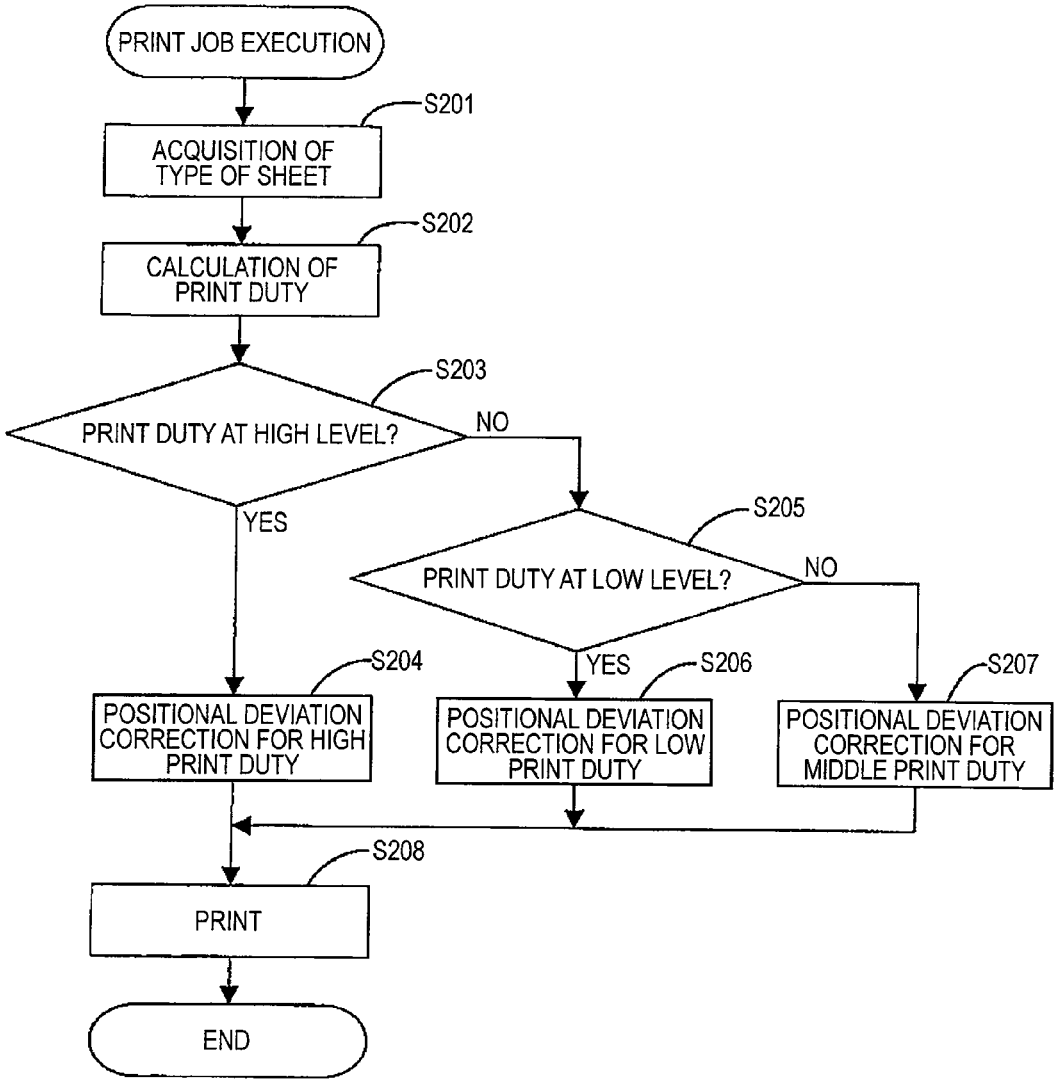
FIG. 12 is a flow chart showing print job execution processing.

FIG. 12 is a flow chart showing print job execution processing. When the print instruction data transmitted from an external computer is received through the network interface 44, the CPU 40 registers the print instruction data as a print job in a print queue and starts the print job execution processing shown in FIG. 12.

In the print job execution processing, first, the CPU 40 acquires the type of sheet 3 used for printing (S201). For example, this may be realized by causing the user to input the information on the type of the sheet 3 set in the supply tray 4 beforehand. When the print instruction data includes the sheet designation information, the type of sheet 3 may be acquired from the information.

Then, the CPU 40 calculates the print duty of a print job to be processed (S202). As described above, this print duty is calculated by the rate of the number of pixels to which toner adheres with respect to the number of pixels corresponding to the printing region on the sheet 3. The print duty calculated herein is a total value of a print duty of toner of all colors in a printed image. However, instead of the actual print duty, a value to which the weighting factor corresponding to each kind of toner is added may be used.

That is, for example, regarding a toner image of black transferred onto the sheet 3 at the most upstream side, the print duty (use level) may affect the formation positions of all toner images, which are located at the more downstream side than the toner image of black, including the toner image of black itself. On the other hand, for example, regarding a toner image of cyan transferred onto the sheet 3 at the most downstream side, an influence of the print duty on the formation position is smaller than that of the toner image at the upstream side because transfer of toner images of other colors has ended at least partially at the point of time when the transfer of the toner image of cyan starts.

Therefore, taking such a difference in influences caused by toner into consideration, the value adjusted such that the weighting factor of the print duty of toner at the upstream side is larger than that at the downstream side is used as the print duty. Specifically, for example, it is possible to use only the print duty of black at the most upstream side or to use the print duty of black at the most upstream side and the print duty of magenta at the next upstream side without using the print duties of other toner. Alternatively, the value which is the sum of values obtained by multiplying the print duties of toner of respective colors by "1.0", "0.8", "0.6", and "0.4", respectively, for example, in order from the upstream side may be used as the above print duty in step S202. By multiplying the weighting factor for each toner, determination of the correction value to be described below can be performed more appropriately.

Then, the CPU 40 determines which level of high, middle, and low the calculated print duty corresponds to. When the print duty is at the high level (S203: Yes), the positional deviation correction value for the print duty of the high level which is stored in the NVRAM 43 is read for each correction color (S204). Herein, the correction value corresponding to the type of the sheet 3 acquired in S201 is read. When the print duty is at the low level (S205: Yes), the correction value for the print duty of the low level is read (S206). When the print duty is at the middle level (S205: No), the correction value for the print duty of the middle level is read (S207).

Then, the CPU 40 executes printing on the basis of a print job (S208). In this case, the CPU 40 corrects the deviation between the image forming positions of respective colors in the sub-scanning direction by adjusting the timing at which an image of each color is written by each of the exposure sections 17K to 17C, for example, using the read positional deviation correction value. Accordingly, an image is printed on the sheet 3 in a state where the image forming position is corrected by the correction value corresponding to the print duty.

When the print job corresponds to the printing of a plurality of sheets 3, it is possible to calculate the average print duty of all pages and to perform the printing on all sheets 3 with the same correction value. Alternatively, it is also possible to calculate the print duty for each of the sheets 3 and to perform the correction on each of the sheets 3 using the correction value corresponding to the print duty.

(Effects of the Illustrative Embodiment)

As described above, according to the above-described illustrative embodiment, it is possible to improve the precision of positional deviation correction by correcting the position of an electrostatic latent image using the correction value corresponding to the use level of toner (amount or coverage of toner) in a toner image.

The precision of positional deviation correction can be improved by further changing the correction value according to the type of the sheet 3.

Further, since the patterns P1 to P4 for measurement of positional deviation are formed and the correction value is set on the basis of the measurement result of the patterns P1 to P4, the precision of correction can be ensured compared with the case of using the value stored beforehand at the time of shipment of products, for example.

In addition, since the patterns P3 and P4 for measurement of positional deviation are formed on the sheet 3 and the user sets the correction value on the basis of the measurement result input by measuring the positional deviation using the pattern on the sheet 3, the precision of correction can be ensured.

In addition, the correction value is determined on the basis of the measurement result of the plurality of patterns P1 and P2 or P3 and P4 with different use levels of toner. Accordingly, the precision of correction can be further improved.

In addition, the plurality of patterns P3 and P4 with different use levels of toner are formed on the sheet 3, and the correction value is determined on the basis of a measurement result of each of the patterns P3 and P4. In this case, since each of the patterns P3 and P4 is formed under the situation close to actual image formation, the precision of correction can be further improved.

In addition, the rotation phases of the photosensitive drums 28 at the reference position (for example, a first mark) when forming a toner image of the measurement mark portions 57A to 57F are made to match each other between the plurality of patterns P3 and P4. Accordingly, since the rotation phases of the photosensitive drums 28 when forming measurement mark portions become approximately equal, the measurement mark portions 57A to 57F are not easily affected by fluctuating positional deviation even if the fluctuating positional deviation matching the rotation period of the photosensitive drum 28 occurs due to the eccentricity of the photosensitive drum 28, for example. Accordingly, the measurement precision can be ensured.

In addition, when determining the correction value, the weighting factor of the use level of toner in a toner image transferred at the upstream side is set to be larger than that of the use level of toner transferred at the downstream side. That is, since it is thought that an influence of the use level of toner, which is transferred at the upstream side, on the positional deviation state is larger than an influence of the use level of toner transferred at the downstream side, the correction value can be appropriately determined by setting the weighting factor of the use level of toner at the upstream side to be larger than that at the downstream side.

<Other Illustrative Embodiments >

While the present invention has been shown and described with reference to certain exemplary embodiments thereof, it will be understood by those skilled in the art that various changes in form and details may be made therein without departing from the spirit and scope of the invention as defined by the appended claims. For example, the following illustrative embodiments are also included in the scope of the invention.

Figure 13:
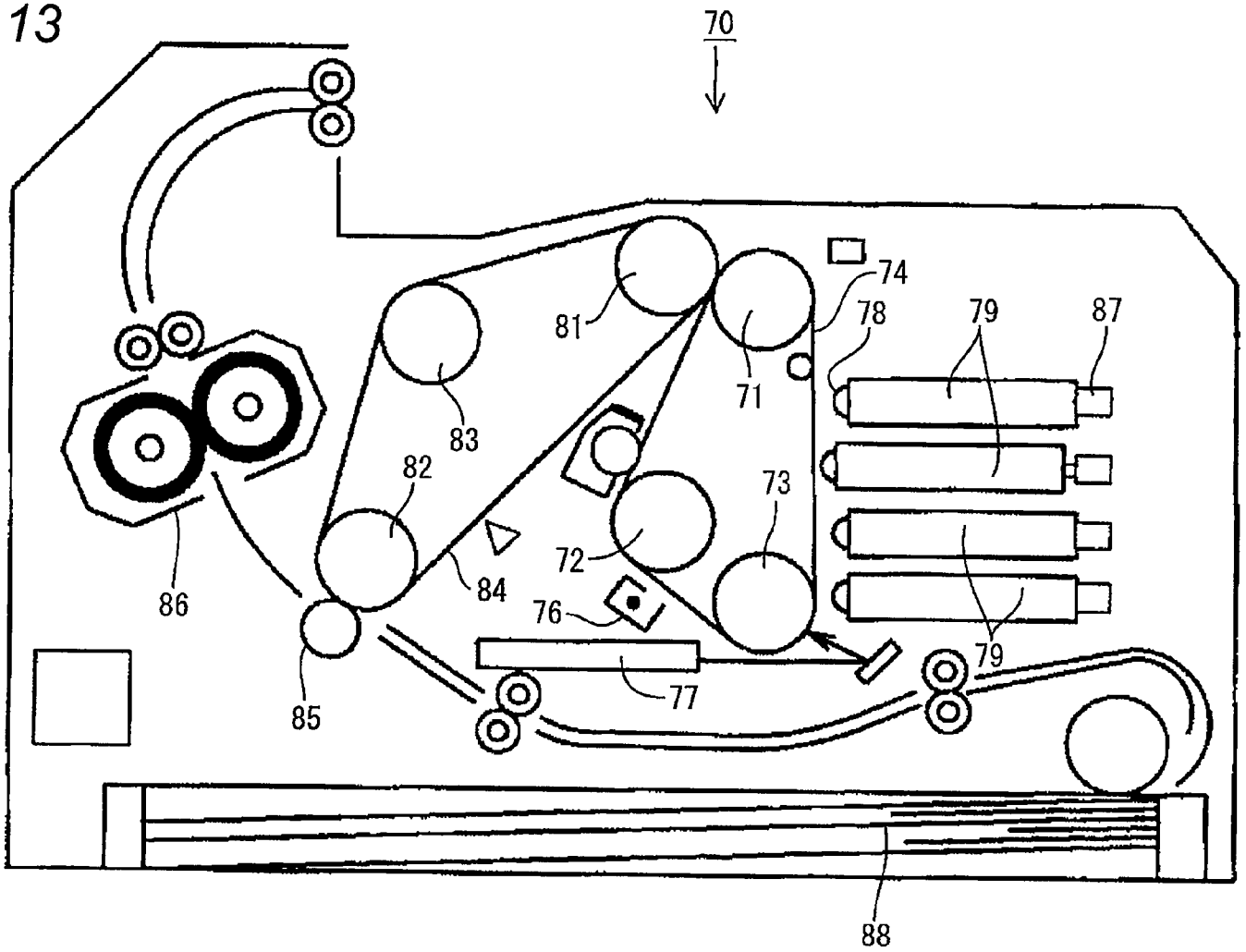
FIG. 13 is a side sectional view schematically showing an image forming apparatus according to another illustrative embodiment.

(1) Although the direct transfer type image forming apparatus is described in the above illustrative embodiment, the inventive concept of the present invention may also be applied to an intermediate transfer type image forming apparatus shown in FIG. 13, for example.

Specifically, an image forming apparatus 70 includes a photosensitive belt 74 supported on three rollers 71, 72, and 73, a charger 76, a scanner 77, four developing cartridges 79 each of which has a developing roller 78 and accommodates toner of a corresponding one of four colors, an intermediate transfer belt 84 supported by the three rollers 81, 82, and 83, a transfer roller 85 which rotates by rotation of the roller 82, a fixer 86, and the like.

At the time of printing, the photosensitive belt 74 is driven to rotate and the surface is uniformly charged by the charger 76, and the charged portion is exposed by laser light emitted from the scanner 77. As a result, an electrostatic latent image is formed. Then, one developing roller 78 of the four developing cartridges 79 comes in contact with the photoconductor belt 74 by an operation of a solenoid 87, such that an electrostatic latent image is developed by toner of one color. Then, the intermediate transfer belt 84 is driven to rotate and a toner image on the photoconductor belt 74 is transferred onto the intermediate transfer belt 84. By repeating the same operation for four colors, toner images of the respective colors are sequentially transferred from the photoconductor belt 74 onto the intermediate transfer belt 84 so as to overlap each other. Then, when sheet 88 is interposed between the intermediate transfer belt 84 and the transfer roller 85, the toner image on the intermediate transfer belt 84 (multi-color developer image) is transferred on the sheet 88. The sheet 88 on which the toner image has been transferred is fixed by the fixer 86 and is then discharged to the outside of the apparatus.

Also in the image forming apparatus 70, the magnitude of the frictional force between the photoconductor belt 74 (an example of a first carrier) and the intermediate transfer belt 84 (an example of a second carrier) may change with the use level of toner in a toner image. The change in the frictional force causes a change in a state of, for example, extension of both the belts 74 and 84 or slipping between both the belts 74 and 84 and corresponding rollers. As a result, since the relative movement speed between both the belts 74 and 84 changes, the image forming position of an image deviates. Therefore, by correcting the positional deviation on the basis of the correction value according to the use level of toner when forming an image, it is possible to improve the quality of the image.

It is noted that in the image forming apparatus 70, the state of positional deviation may similarly change according to the use level of toner between the intermediate transfer belt 84 and the sheet 88. In this case, the intermediate transfer belt 84 is an example of the first carrier, the transfer roller is an example of the second carrier, and the sheet is an example of a recording medium.

(2) The inventive concept of the present invention may be applied to other types of image forming apparatuses having a configuration in which the use level of developer in a transferred developer image affects the position of a carrier or a recording medium, such as a transfer drum type image forming apparatus. Further, the inventive concept of the present invention may also be applied to a monochrome image forming apparatus. That is, in the case where monochromatic developer is used, the use level of developer in a developer image may affect the movement speed of a carrier or a recording medium carrying the developer image, and therefore, the image forming position on the recording medium may deviate.

(3) In the above-described illustrative embodiment, the positional deviation correction value is set on the basis of a measurement result of two kinds of patterns. However, the positional deviation correction value may be set on the basis of a measurement result of one kind of pattern, or the positional deviation correction value may be set on the basis of a measurement result of three or more kinds of patterns. In addition, it is also possible to store the positional deviation correction value, which is calculated by measurement at the time of manufacturing or the like, in a memory and to use the value at the time of correction, without providing a function of measuring the amount of positional deviation in the image forming apparatus itself.

(4) Although the correction value corresponding to the print duty is mainly shown as the use level of toner in the above-described illustrative embodiment, it is also possible to use various kinds of values, such as the amount of toner and the coverage of toner as described above. For example, the correction value may be changed according to the amount of toner of an image, or the correction value may be changed according to both the amount of toner and the coverage of toner.

(5) An image used as a pattern for measuring the positional deviation is not limited to those described above, and may be appropriately changed. For example, when a plurality of patterns is used, difference pattern portions with different image concentrations may be used to calculate the correction value corresponding to the concentration difference. In this case, for example, average concentration of a toner image formed on sheet can be calculated as the use level of toner and correction can be performed using the correction value corresponding to the concentration.

(6) In the above-described illustrative embodiment, recording media is divided into three types and the correction value is changed according to the type of recording medium used. However, types of recording media may be divided, for example, according to a material or presence of coating, and the correction value may be changed according to the divided type. In addition, when measurement is performed in a state where a pattern is formed on a recording medium, the measurement may be performed using a plurality of different types of recording media. Alternatively, the measurement may be performed regardless of the type of recording medium.

(7) In the above-described illustrative embodiment, the driving speed of the belt (second carrier) or the sheet (recording medium) is set to be larger than that of the photosensitive drum (first carrier). However, the driving speed of the first carrier may be set to be larger than that of the second carrier or the recording medium, or the driving speed of the first carrier may be set to be equal to that of the second carrier or the recording medium. That is, since a slight speed difference occurs between both the first and second carriers even if the first carrier and the second carrier (or the recording medium) are generally set to have the same speed, the use level of a developer may affect the positional deviation state of an image.

What is claimed is:

1. An image forming apparatus comprising:

an exposure section configured to form an electrostatic latent image based on image data;

a developing section configured to supply developer to the electrostatic latent image to form a developer image;

a first carrier configured to rotate while carrying thereon the developer image formed by the developing section;

a second carrier configured to interpose a recording medium with the first carrier and configured to indirectly carry the developer image transferred from the first carrier to the recording medium; and a controller configured to:

acquire a use level of developer corresponding to at least one of an amount of developer and a coverage of developer in the developer image based on the image data, and correct a formation position of the electrostatic latent image using a correction value which is based on the acquired use level of developer.

2. The image forming apparatus according to claim 1, wherein the controller is further configured to change the correction value according to a type of the recording medium.

3. The image forming apparatus according to claim 1, wherein the controller is further configured to:

measure a pattern for positional deviation measurement, formation of the pattern as a developer image, and determine the correction value based on a measurement result of the measured pattern.

4. The image forming apparatus according to claim 1, further comprising:

an input section configured to receive an input of a measurement result of a positional deviation based on a pattern for positional deviation measurement, and wherein the controller is further configured to:

cause formation of the pattern on the recording medium as a developer image, and determine the correction value based on the measurement result input through the input section.

5. The image forming apparatus according to claim 3, wherein the controller is further configured to:

cause formation of a plurality of patterns with different use levels of developer, and determine the correction value based on a measurement result for each of the plurality of measured patterns.

6. The image forming apparatus according to claim 4, wherein the controller section is configured to:

cause formation of each of a plurality of patterns with different use levels of developer on a different recording medium, and determine the correction value based on a measurement result for each of the plurality of measured patterns.

7. The image forming apparatus according to claim 5, wherein each of the plurality of patterns includes a measurement mark portion having a mark group for measuring positional deviation in a rotation direction of the first carrier, and wherein when forming the plurality of patterns, the exposure section forms an electrostatic latent image such that a rotation phase of the first carrier at a reference position for forming a developer image of the measurement mark portion matches with each other among the plurality of patterns.

8. The image forming apparatus according claim 1, wherein the first carrier includes a plurality of first carriers configured to carry developer images of different colors, respectively, wherein the second carrier is configured to carry a multicolor developer image obtained by overlapping the developer images transferred sequentially by the plurality of first carriers in an order from an upstream side first carrier to a downstream side first carrier, wherein the controller is further configured to determine the correction value using weighting factors for use levels of developer in the plurality of developer images, and wherein the weighting factor for the developer image from the upstream side first carrier is larger than that from the downstream side first carrier.

9. An image forming apparatus comprising:

an exposure section configured to form an electrostatic latent image based on image data;

a developing section configured to supply developer to the electrostatic latent image to form a developer image;

a first carrier configured to rotate while carrying thereon the developer image formed by the developing section;

a second carrier configured to rotate while contacting the first carrier, and configured to carry the developer image transferred from the first carrier to transfer the carried developer image on a recording medium directly or indirectly; and a controller configured to:

acquire a use level of developer corresponding to at least one of an amount of developer and a coverage of developer in the developer image based on the image data, and correct a formation position of the electrostatic latent image using a correction value which is based on the acquired use level of developer.

10. The image forming apparatus according to claim 9, wherein the controller is further configured to change the correction value according to a type of the recording medium.

11. The image forming apparatus according to claim 9, wherein the controller is further configured to:

measure a pattern for positional deviation measurement, cause formation of the pattern as a developer image, and determine the correction value based on a measurement result of the measured pattern.

12. The image forming apparatus according to claim 9, further comprising:

an input section configured to receive an input of a measurement result of a positional deviation based on a pattern for positional deviation measurement, and wherein the controller is further configured to:

cause formation of the pattern on the recording medium as a developer image, and determine the correction value based on the measurement result input through the input section.

13. The image forming apparatus according to claim 11, wherein the controller is further configured to:

cause formation of a plurality of patterns with different use levels of developer, and determine the correction value based on a measurement result for each of the plurality of measured patterns.

14. The image forming apparatus according to claim 12, wherein the controller is further configured to:

cause formation of each of a plurality of patterns with different use levels of developer on a different recording medium, and determine the correction value based on a measurement result for each of the plurality of measured patterns.

15. The image forming apparatus according to claim 13, wherein each of the plurality of patterns includes a measurement mark portion having a mark group for measuring positional deviation in a rotation direction of the first carrier, and wherein when forming the plurality of patterns, the exposure section forms an electrostatic latent image such that a rotation phase of the first carrier at a reference position for forming a developer image of the measurement mark portion matches with each other among the plurality of patterns.

16. The image forming apparatus according claim 9, wherein the first carrier includes a plurality of first carriers configured to carry developer images of different colors, respectively, wherein the second carrier is configured to carry a multicolor developer image obtained by overlapping the developer images transferred sequentially by the plurality of first carriers in an order from an upstream side first carrier to a downstream side first carrier, wherein the controller is further configured to determine the correction value using weighting factors for use levels of developer in the plurality of developer images, and wherein the weighting factor for the developer image from the upstream side first carrier is larger than that from the downstream side first carrier.

17. An image forming apparatus comprising:

a plurality of photosensitive drums configured to be rotationally driven;

a plurality of exposure sections configured to form electrostatic latent images, based on image data, on the photosensitive drums, respectively;

a plurality of developing sections configured to supply developer to the electrostatic latent images to form developer images, respectively;

a belt configured to transport a recording medium so that the recording medium contacts the plurality of developing sections;

a plurality of transfer sections configured to transfer the developer images formed on the plurality of photosensitive drums onto the recording medium on the belt, respectively; and a controller configured to acquire a use level of developer corresponding to at least one of an amount of developer and a coverage of developer in the developer images based on the image data, and correct a formation position of the electrostatic latent images using a correction value which is based on the acquired use level of developer.

18. The image forming apparatus according to claim 17, wherein the controller is further configured to correct the formation position in a sub-scanning direction along an aligning direction of the plurality of photosensitive drums.

* * * * *